US005260508A

United States Patent [19]

Bruti et al.

[11] Patent Number: 5,260,508

[45] Date of Patent: Nov. 9, 1993

[54] PARAMETER SETTING SYSTEM IN AN ELECTRONIC MUSICAL INSTRUMENT

[75] Inventors: Luigi Bruti, Pedaso; Demetrio Cuccu, Fermo; Francesco Rauchi, San Benedetto Del Tronto, all of Italy

[73] Assignee: Roland Europe S.p.A., Teramo, Italy

[21] Appl. No.: 834,397

[22] Filed: Feb. 12, 1992

[30] Foreign Application Priority Data

Feb. 13, 1991 [IT] Italy ..... MI91 A 000357

[51] Int. Cl.[5] ..... G10H 1/06

[52] U.S. Cl. ..... 84/622; 84/602; 84/615

[58] Field of Search ..... 84/602, 622, 626, 629, 84/630, 645, 647, 659

[56] References Cited

U.S. PATENT DOCUMENTS 4,791,847 12/1988 Nishimoto ..... 84/622

4,915,007 4/1990 Wachi et al. ..... 84/622

*Primary Examiner*—William M. Shoop, Jr.

*Assistant Examiner*—H. Kim

*Attorney, Agent, or Firm*—Keck, Mahin & Cate

[57] ABSTRACT

In a parameter setting system for setting tone characters for producing musical tones in an electronic musical instrument, with respect to a plurality of tone characters having the same values as to a certain parameter, one group is made up with these plural tone characters, and parameters are stored in every group, whereby a required memory size is reduced. Further, respective tone characters are classified into a plurality of groups, and parameter setting and changing operations are executed in every group, whereby these operations are simplified.

4 Claims, 5 Drawing Sheets

FIG. 2

| Tone Color Parameter Memory | | | | | | |
|---|---|---|---|---|---|---|
| | | | | | | Tone Color-Group Collative Table |
| Tone Color No. | Parameter No.1 | Parameter No.2 | Parameter No.3 | ---- | Parameter No.16 | Belonging Group |
| 1 | 10 | 20 | 15 | ------ | 8 | B |
| 2 | 2 | 9 | 40 | ------ | 10 | A |
| 3 | 1 | 10 | 35 | ------ | 9 | C |
| 4 | 8 | 15 | 20 | ------ | 10 | D |
| ⋮ | ⋮ | ⋮ | ⋮ | | ⋮ | ⋮ |
| 100 | 10 | 25 | 15 | ------ | 9 | A |

FIG. 3

| Tone Color Parameter Memory Classified by Groups | | | | |
|---|---|---|---|---|
| Group | Parameter No.17 | Parameter No.18 | Parameter No.19 | Parameter No.20 |
| A | 3 | 9 | 3 | 10 |
| B | 2 | 2 | 4 | 8 |
| C | 3 | 3 | 4 | 4 |
| D | 2 | 1 | 5 | 0 |

| Current Group Memory | |
|---|---|
| MIDI Channel | Group |
| 1 | A |
| 2 | B |
| 3 | A |

FIG. 4

PARAMETER SETTING SYSTEM IN AN ELECTRONIC MUSICAL INSTRUMENT

BACKGROUND OF THE INVENTION

Field of the Invention

This invention relates to a parameter setting system, and particularly to a parameter setting system being capable of setting or changing parameters of tone color, pitch, volume or effect imparted thereto (depth of vibrato effect, speed of vibrato effect or depth of reverberation (reverberant effect) and the like, hereinafter referred to simply as "tone characters" which are elements for producing musical tones in an electronic musical instrument in which such musical tones to be used for a performance are selected from a plurality of the musical tones preset.

Description of the Related Art

Heretofore, in a parameter setting system in an electronic musical instrument, parameters have previously been set and stored therein in response to various colors, pitches, volume of musical tone or the effects imparted thereto and the like in order to produce various musical tones. Thus, plural types of parameters are required for a certain tone character, so that the respective tone characters involve plural types of parameters in every tone character. For this reason, a prior parameter setting system has individually stored all the types of parameters required for each of tone characters in every musical tone, respectively.

In such an electronic musical instrument as described above, when a tone color is selected by a device for outputting key event data such as a keyboard or a guitar type controller in order to produce, for example, a certain desired tone color, all the types of parameters required for producing the single tone color are output for the parameter setting system to a musical tone producing means in order to produce the tone color.

The matter as described above is not only related to tone color, but also pitch and volume of musical tone or effect imparted thereto and the like, so that all the types of parameters necessary for producing the respective tone character are sent from such a parameter setting system which have stored individually all the types of parameters in every tone character to a musical tone producing means.

Moreover, with the recent progress in musical tone producing technique, the number of parameters, required for producing a certain tone character increases more and more, so that a memory size to be stored in a parameter setting system increases.

Meanwhile, in the case where delicate performance by an acoustic piano is reproduced in an electronic musical instrument or the like case, it is necessary for setting a sound produced by playing "forte" on the acoustic piano and a sound produced by playing "piano" on the acoustic piano as separate tone colors such as acoustic piano tone color A, acoustic piano tone color B and the like. In this case, according to a conventional parameter setting system, all the types of parameters required for the aforesaid respectively tone colors have been separately set from each other. There is a case where these acoustic piano tone colors A and B are properly used at a part of performance even in a piece of music. Accordingly, in case of automatic performance by means of a sequencer, it was difficult for an audience to discriminate that a performing acoustic piano tone color was either the acoustic piano tone color A or B by only hearing the sound performed automatically except for such audiences who are well informed of the electronic musical instrument being played.

For example, in the case where an operator intends to cange a tone color as a result of hearing the tone color of acoustic piano which was automatically performed, it is necessary to change parameters of the tone color. In this case, therefore, the operator must confirm that the tone color now on set is either acoustic piano tone color A or acoustic piano tone color B by visual observation through indication of tone color number of the tone color set or the like manner, and then the operator decides that the parameter of which tone color should be changed.

More specifically, if there is such an intention to change a parameter, it is required to confirm a specific name or tone color number and the like of the tone color to be changed by operator's visual observation or the like manner.

In the meantime, in case of a multi-timbre sound source which functions for a plurality of parts by a single sound source, it is constructed in such a way that different tone colors can be sounded in every MIDI channel. In case of such a multi-timbre sound source, it could not have been heretofore confirmed that a preset tone color is either acoustic piano tone color A or acoustic piano tone color B so far as the tone color numbers preset in respective MIDI channel are successively confirmed until such MIDI channel set the tone color number of either acoustic piano tone color A or B is found.

In a conventional parameter setting system, all the types of parameters required for producing a certain tone character have been stored in every musical tone. Thus, because of the increase of a memory size with the recent increase of number parameters, a memory system becomes inevitably large-sized, so that a problem of becoming disadvantageous from the viewpoint of cost arises.

Furthermore, a conventional parameter setting system involves another problem in that since all the types of parameters are stored individually for respective tone characters for each musical tone, an individual setting operation must be repeated in every tone character in order to set the same type of parameter for a plurality of musical tone with the same value, thus such operations are quite troublesome.

A conventional parameter setting system involves a still further problem in that since all the types of parameters necessary for respective tone characters are set individually, an operator must confirm that the questioned tone character is what kind of musical tone in the case where a need for changing parameters for a certain tone character exists, thus such confirming operation is difficult, besides complicated.

OBJECTS AND SUMMARY OF THE INVENTION

The present invention has been made in view of the problems as described above involved in the prior art, and an object of the invention is to provide a parameter setting system which is constructed in such a way that because there are many cases where some types of prescribed parameters have the substantially same values with respect to a plurality of tone characters being similar to each other in respect to different musical tones of same musical instruments a single group is made from such a plurality of the characters having the same values in reference to a certain parameter, i.e., prescribed parameters of the same value are stored in every group, and such parameters of the same value are made in common with each other among the plural tone characters to set them, whereby a required memory size is reduced.

Another object of the present invention is to provide a parameter setting system wherein respective tone characters are classified into a plurality of groups, and operations for setting and changing parameters are effected in every group thereby to simplify such operations.

In order to attain the above described objects, the parameter setting system according to the present invention is constructed as follows.

With respect to parameters as to tone characters required for producing different musical tones, prescribed types of parameters among those belonging to a same category of tone characters (any of color, pitch, volume of music tone or effect imparted thereto and the like) are not individually stored in every tone character, but are grouped in a number of groups smaller than the total number of the respective tone characters of the same category, and are set by means of a parameter memory means classified by groups, the prescribed types of parameters are stored in every of these groups, the prescribed types of parameters stored in every group are arranged to commonly use among the individual tone characters of the same category comprising these groups, all the questioned respective tone characters in the same category are allowed to belong to any one of groups, further a group specifying means for specifying the groups to which the respective tone characters belong is provided, and when the respective tone characters are designated, such parameters as tone characters of the respective musical tones to be produced are set on the basis of both the parameters stored individually in every tone character by means of the parameter storing means and the prescribed types of parameters in groups to which the questioned tone character belong and which are stored by means of the parameter storing means classified by groups, and these both parameters are sent to a musical tone producing means by the use of respective parameter output means.

Furthermore, the other parameter setting system according to the present invention is constructed as follows.

In the case where there are a plurality of musical tone producing means in an electronic musical instrument, a means for storing a corresponding relationship, to the effect that which musical tone producing means has been set to the tone character belonging to which group between groups of parameter and the musical tone producing means and a parameter changing means for specifying a group and changing parameters of the respective tone character belonging to the group are provided, and when the group is specified to change the parameters, the parameters thus changed are sent out to such a musical tone producing means corresponding to the specified group stored by means of the corresponding relationship storing means by the use of a means for outputting the parameters changed, whereby values of the prescribed types of parameters are changed all together with respect to a plurality of tone characters of the same category belonging to the same group.

Examples of construction for the group classification include one classified on the basis of a widely admitted general criterion of tone color property or the like such as a piano group or a brass group in category of, for example, tone color, one designated by envelope, one designated by the waveform used, one derived from a MIX ratio of plural types of waveform and the like.

According to the parameter setting system of the present invention, with respect to such parameters having the common value among some tone characters in the same category, all the types of respective parameters are not individually stored, but a single group is composed of a plurality of tone characters for which such common parameter values as described above are used. In every such a group, a common parameter value among the questioned group is allocated to the questioned group as a representational value for this group, and only the representational value of the group is stored for the common parameter value.

In the case where tone characters are selected, such a group to which the tone characters belong is designated, so that a parameter value representing the belonging group is output to a musical tone producing means with respect to the parameters those belonging to the group. In these circumstances, when there are the more common parameters among a plurality of tone characters, the more parameters which may be stored as only those belonging to such a group increase. On one hand, such parameters which must be separately stored in every tone character descrease. Thus, a memory size can be reduced in the parameter setting system of the present invention as a whole.

Moreover, when such parameters which are common to a plurality of tone characters and have been set in every group are changed, then the questioned parameters are changed at the same time with respect to a plurality of the tone characters in the questioned group. As a result, the operation for changing parameters becomes simple.

In addition, when a group is specified and a parameter is changed by means of a parameter changing means, a musical tone producing means which have been set the tone character belonging to the specified group is detected so that the parameter is changed with respect to the detected musical tone producing means. Accordingly, there is no need to individually confirm that the objective tone character for changing parameter is what type of tone character. Thus, the operation for changing parameter is simplified.

The classification by groups in respective categories may be classified in accordance with a concept or a property which is commonly used. Taking an example as to tone color, electronic piano sound (bright), electronic piano sound (mellow), acoustic piano A (sound produced by playing forte on a piano), acoustic piano B (sound produced by playing piano on a piano) and the like have been widely recognized by the general public as sounds derived from piano, so that these sounds are classified into a piano tone color group. As a result of such classification, any audience can easily judge that the questioned sound belongs to which tone color group by only hearing the sounds now produced. Thus, in the case where there is a need to change a parameter, the operation for changing the parameter can be made by merely hearing the questioned sound without accompanying such procedure that an operator confirms individually and specifically the name of tone color or tone color number which is the object for changing said parameter by the operator's visual observation and the like.

Further, even in the case where musical tone producing means is a multi-timbre, it is also not required each time for confirming by visual observation or the like that the color tone number being the object for changing a parameter is allocated to which MIDI channel, but an operator can change such parameter by merely hearing the questioned sound.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

The accompanying drawings illustrate an embodiment of the present invention in which:

FIG. 2 is an explanatory diagram showing an example of the memory contents of a tone color parameter memory in the parameter setting system of the present invention;

FIG. 3 is an explanatory diagram showing an example of the memory contents of a tone color parameter memory classified by groups in the parameter setting system of the present invention;

FIG. 4 is an explanatory diagram showing an example of the memory contents of a current group memory in the parameter setting system of the present invention;

DETAILED DESCRIPTION OF THE PREFERRED EMBODIMENTS

An embodiment of the parameter setting system according to the present invention will be described in detail hereinbelow by referring to the accompanying drawings.

While tone color among tone characters is particularly described in the present embodiment, it is to be noted that the embodiment is also applicable to tone pitch, volume, effect imparted thereto or the like.

Figure 1:
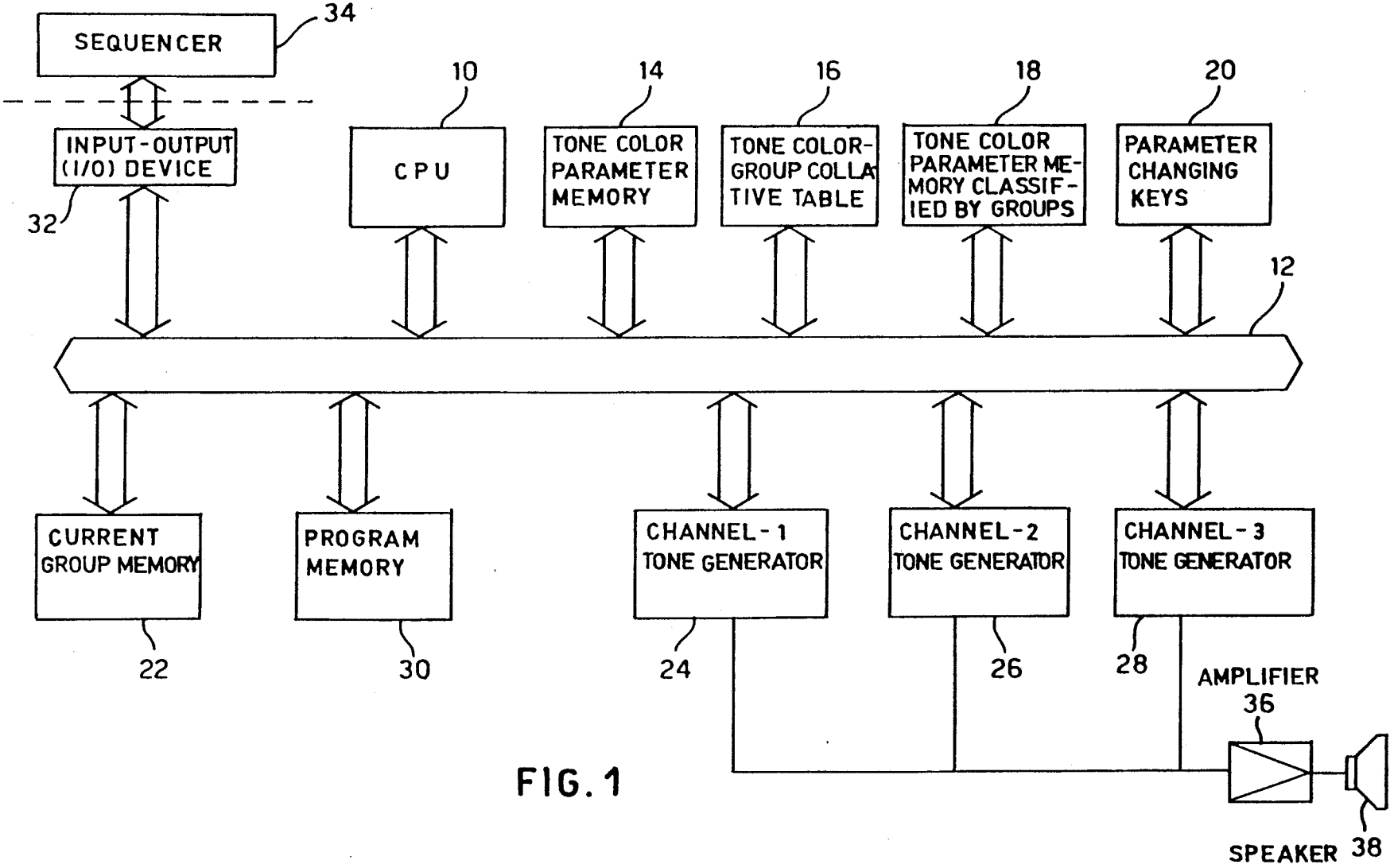
FIG. 1 is a block diagram showing a construction of an electronic musical instrument in which the parameter setting system according to the present invention is used.

An electronic musical instrument shown in FIG. 1 is constructed in such that the whole operation of the electronic musical instrument is controlled by means of central processing unit (CPU) 10. To the CPU 10 are connected, through a bidirectional bus line 12, a tone color parameter memory 14, a tone color group collative table 16, a tone color parameter memory classified by groups 18, parameter changing keys 20, a current group memory 22, a channel-1 tone generator 24, a channel-2 tone generator 26, a channel-3 tone generator 28, a program memory 30 and an input-output (I/O) device 32, respectively. The CPU 10 is further connected with an external sequencer 34 through the input-/output (I/O) device 32. In addition, an amplifier 36 is connected with the channel-1 tone generator 24, the channel-2 tone generator 26 and the channel-3 tone generator 28, respectively. Moreover, since a speaker 38 is connected to the amplifier 36, musical signals output from the channel-1 tone generator 24, the channel-2 tone generator 26 and the channel-3 tone generator 28 are delivered from the speaker 38 as musical tones through the amplifier 36.

The program memory 30 is composed of ROM (read-only memory) and a control program is stored therein.

Furthermore, data of MIDI for automatic musical performance corresponding to a musical composition are stored in the sequencer 34. When the data are reproduced MIDI, performance information is output. The output MIDI performance information is introduced into the electronic musical instrument via the input-output (I/O) device 32.

The MIDI performance information involves key-on information representing production of musical tone and key-off information representing cessation of musical tone as well as tone color numbering information by which such tone color of musical tones to be produced in accordance with key-on information has been previously specified. More specifically, the key-on information instructs commencement of production of such musical tones specified by MIDI channels and tone pitches contained in the key-on information. On the other hand, the key-off information instructs completion of producing musical tones specified by MIDI channels and tone pitches contained in the key-off information same as the case of the key-on information.

Furthermore, the tone color numbering information designates tone color of sound produced on the basis of the key-on information, and it specified such tone color with respect to MIDI channels contained in the tone color numbering information. Accordingly, it becomes possible to independently set tone color in every MIDI channel.

In the present embodiment, tone color numbers 1–100 have been prepared for the tone color parameter memory 14 as shown in FIG. 2, tone color parameters have been stored for 100 tone colors, and a desired tone color may be selected from these parameters by means of a tone color numbering information. In the present embodiment, 20 types of parameters represented by Nos. 1–20 parameters are set for one tone color, and their Nos. 1–16 parameters are set and stored in the tone color parameter memory 14. Thus, 16 types of No. 1–No. 16 parameters are stored separately from one another for all the 100 tone colors. When a tone color is selected by means of the tone color number from the 100 tone colors, it is decided by the MIDI channels involved in the tone color numbering information based on the tone color selected that parameters should be output to which tone generator. As a consequence, 16 types of parameters represented by No. 1–No. 16 parameters are output to any of the channel-1 tone generator 24, the channel-2 tone generator 26 and the channel-3 tone generator 28.

Moreover, 100 tone colors numbered as tone color Nos. 1–100 are classified into four groups A–D. More specifically, the respective tone colors represented by tone color No. 1–No. 100 are classified into any of the groups A–D. The tone color group collative table 16 defines to the effect that a tone color of which tone color number belongs to which of the groups, and such definition is stored in the tone color parameter memory as one of the tone color parameters.

As to the classification by the groups described above, preferable is to classify them in accordance with a general idea such as that of tone color property and the like. For example, electronic piano sound (bright), electronic piano sound (mellow), acoustic piano A (sound produced by playing forte on a piano), acoustic piano B (sound produced by playing piano on a piano) and the like are widely recognized by the general run of people as sounds derived from a piano. Accordingly, these sounds are classified into one group as the one for the sounds derived from piano. According to such classification described above, it is possible to set groups in such a manner that anyone can easily judge which group includes the questioned sound by merely hearing sounds delivered from a speaker.

As shown in FIG. 3, values of four types of parameters represented by Nos. 17-20 parameters are set and stored in the tone color parameter memory classified by groups 18 in every group for the four groups A-D. It is to be noted that these No. 17-No. 20 parameters are different from No. 1- No. 16 parameters. Thus, when a group is specified among the groups A-D on the basis of tone color number, it is decided that four types of parameters of these No. 17-No. 20 parameters corresponding to the group specified should be output to which tone generator in accordance with the MIDI channel involved in the tone color numbering information, so that they are output to the channel-1 tone generator 24, channel-2 tone generator 26 or the channel-3 tone generator 28.

Figure 5:
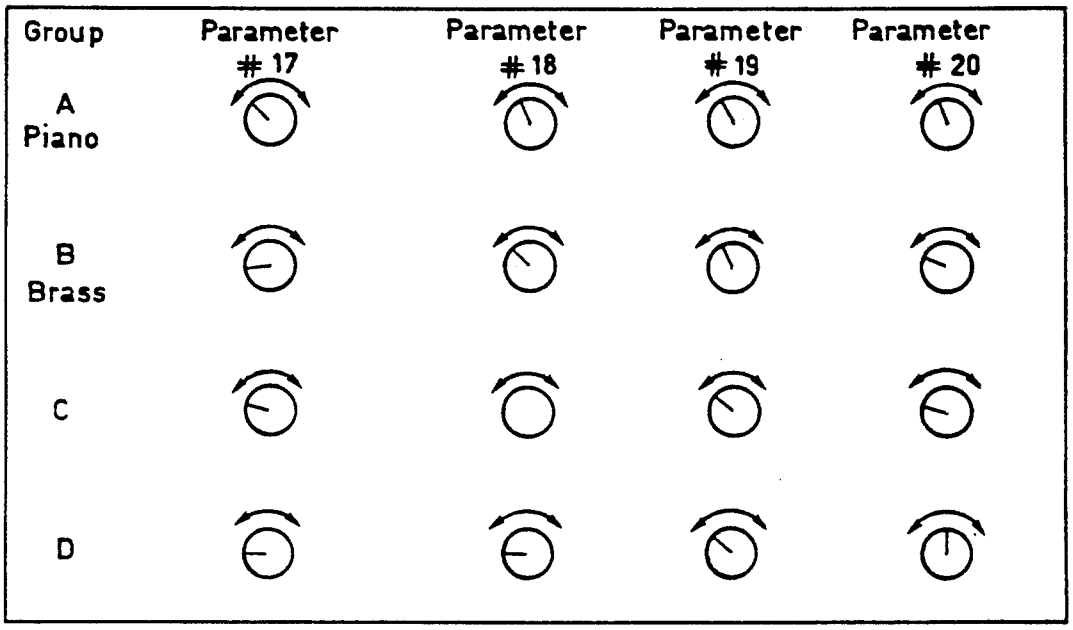
FIGS. 5 and 6 are front views each showing a constructional example of parameter changing keys.
Figure 6:
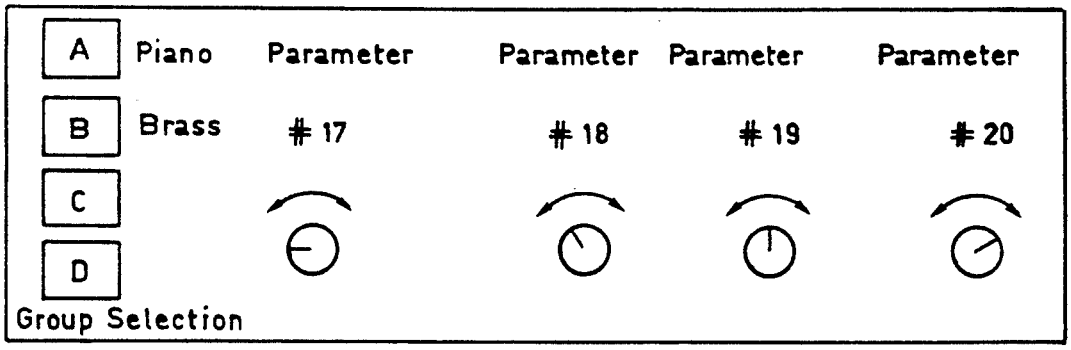

The parameter changing keys 20 are those for changing values of parameters classified by groups of the groups A-D indicated in No. 17-No. 20 parameters stored in the tone color parameter memory classified by groups 18, and these keys may be provided on the surface panel or the like of an electronic musical instrument in the form as shown in FIG. 5 or 6. In FIG. 5, keys for operating Nos. 17-20 parameters are provided in every group, while it is constructed in FIG. 6 in such that the respective groups A-D are selected by pushing down push buttons, and then keys for operating Nos. 17-20 parameters are operated.

It is to be noted that the parameter changing keys 20 are not limited to the form shown in FIG. 5 or 6, but any form is applicable so far as it can specify the groups A-D as well as parameters numbered as Nos. 17-20.

The channel-1 tone generator 25, the channel-2 tone generator 26 and the channel-3 tone generator 28 are provided corresponding to the MIDI channels, respectively. The electronic musical instrument to which the present invention is applied produces musical tones in response to a key-on command (a command for commencing generation of musical tones) contained in the key-on information which is supplied from the CPU 10 via the bus line 12, whilst ceases the musical tone generation in response to a key-off command (a command for completing such musical tone generation) contained in key-off information. Furthermore, the electronic musical instrument can change the color of musical tones produced on the basis of 20 types of parameters, i.e. Nos. 1-20 parameters (more specifically, 16 types of Nos. 1-16 parameters are provided by the tone color parameter memory 14, and 4 types of Nos. 17-20 parameters are provided by the tone color parameter memory classified by groups 18).

The current group memory 22 is one for storing the latest type of groups selected from the groups A-D in every MIDI channel. In other words, a storage area is provided in each MIDI channel as shown in FIG. 4, and stored contents in the storage area are rewritten into the type of groups corresponding to its tone color number in every event where tone color numbering information is supplied.

As a matter of course, it may be arranged in such that the contents of a selected MIDI channels are stored in every group A-D contrary to the one shown in FIG. 4.

In the construction of the invention as described above, the operation of the electronic musical instrument will be described in every step with reference to the flowcharts illustrated in FIGS. 7 and 8.

Figure 7:
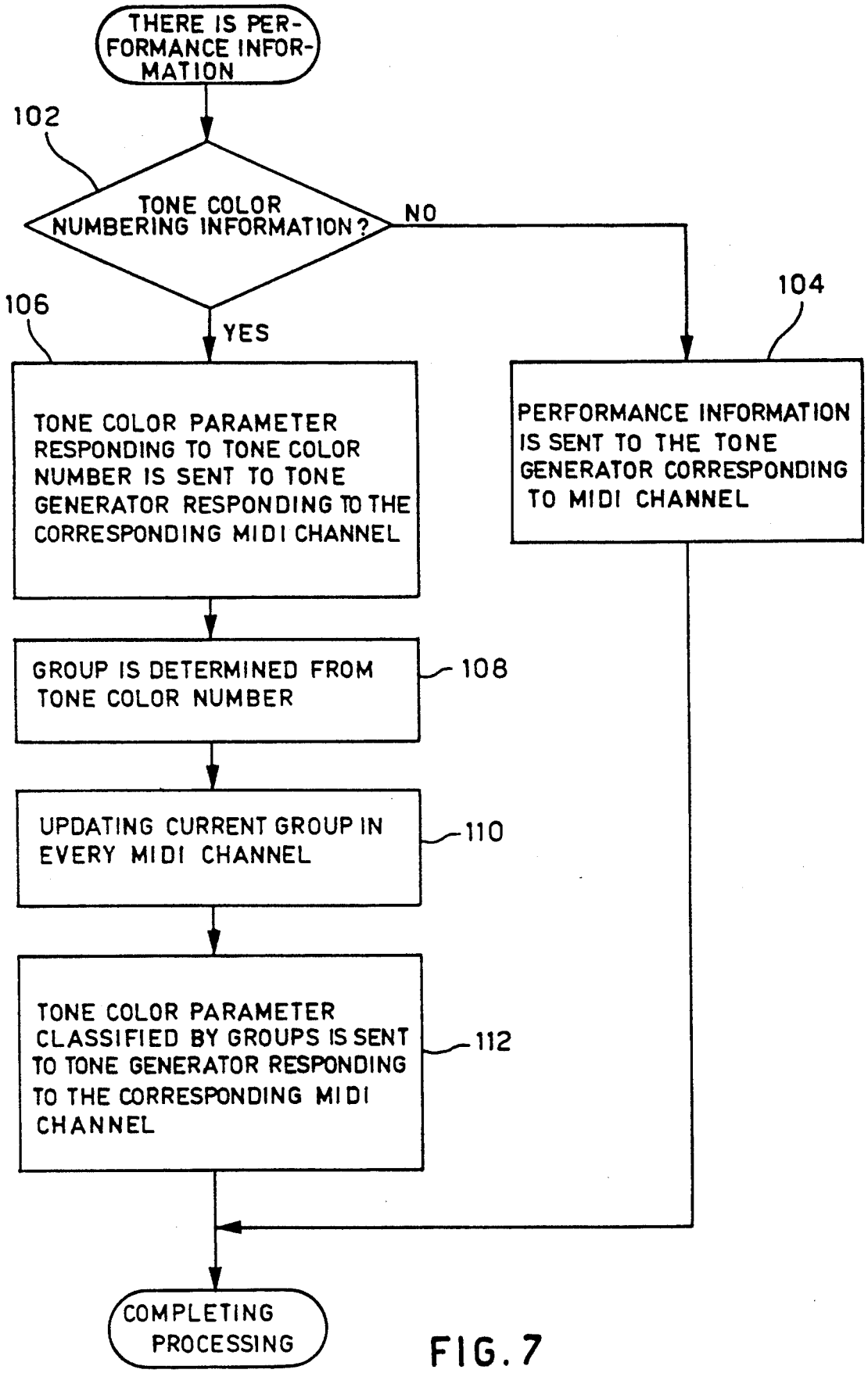
FIG. 7 is a flowchart illustrating a main routine of the program executed by a CPU.

FIG. 7 is a flowchart illustrating a main routine and which consists of the following steps.

Step 102—>step 104: When performance information is inputted from the sequencer 34 through the input-output (I/O) device 32, the performance information other than tone color numbering information such as key-on or key-off information and the like is directly output to the tone generator corresponding to the MIDI channel.

Step 102—>step 106: When tone color numbering information is included in the performance information inputted from the sequencer 34 via the input-output (I/O) device 32, 16 types of parameters Nos. 1-16 parameters corresponding to its tone color number are output from tone color parameter memory 14 shown in FIG. 2 to the tone generator corresponding to the MIDI channel contained in the tone color numbering information.

Step 108: It is decided that the tone color number inputted belongs to which group of the groups A-D by means of the tone color-group collative table 16 which is stored in the tone color parameter memory 14 as shown in FIG. 2, so that the group to which the tone color number inputted belongs is specified.

Step 110: A type of group indicating the groups A-D specified in the step 108 is written in a storage area corresponding to the MIDI channel involved in the tone color numbering information of the current group memory 22 as shown in FIG. 4.

Step 112: 4 types of parameters, Nos. 17-20 parameters are sent from the tone color parameter memory classified by groups 18 in response to the groups A-D written in the current group memory 22 as shown in FIG. 3 to the tone generator corresponding to the MIDI channel in such a manner that such MIDI channel written in the current group memory 22 corresponds to the group each other.

In accordance with the main routine shown in FIG. 7, for example, when performance information involving the tone color numbering information designating tone color No. 2 is sent to the MIDI channel-1 from the sequencer 34, parameters Nos. 1-16 corresponding to tone color No. 2 are read from the tone color parameter memory 14, and these parameters are sent to the channel-1 tone generator 24. It is decided from the tone color-group collative table 16 in the tone color parameter memory 14 that tone color No. 2 belongs to the group A, so that the group A is written in the storage area corresponding to the MIDI channel-1 in the current group memory 22. From the tone color parameter memory classified by groups 18, the parameters Nos. 17-20 corresponding to the group A written in the storage area corresponding to the MIDI channel-1 in the current group memory 22 are read, and they are sent to the channel-1 tone generator 24.

In accordance with the manner described above, twenty (or 20 types of) parameters Nos. 1-20 are sent to the channel-1 tone generator 24.

Thereafter, when such performance information containing the key-on information with respect to a certain pitch and volume of musical tone is sent, for example, from sequencer 34 to the MIDI channel-1, the key-on information is directly supplied to the channel-1 tone generator 24, so that musical tones having the tone color in accordance with the twenty parameters set according to the manner as described above as well as the pitch and volume of musical tone in response to the key-on information are sounded from the speaker 38.

Figure 8:
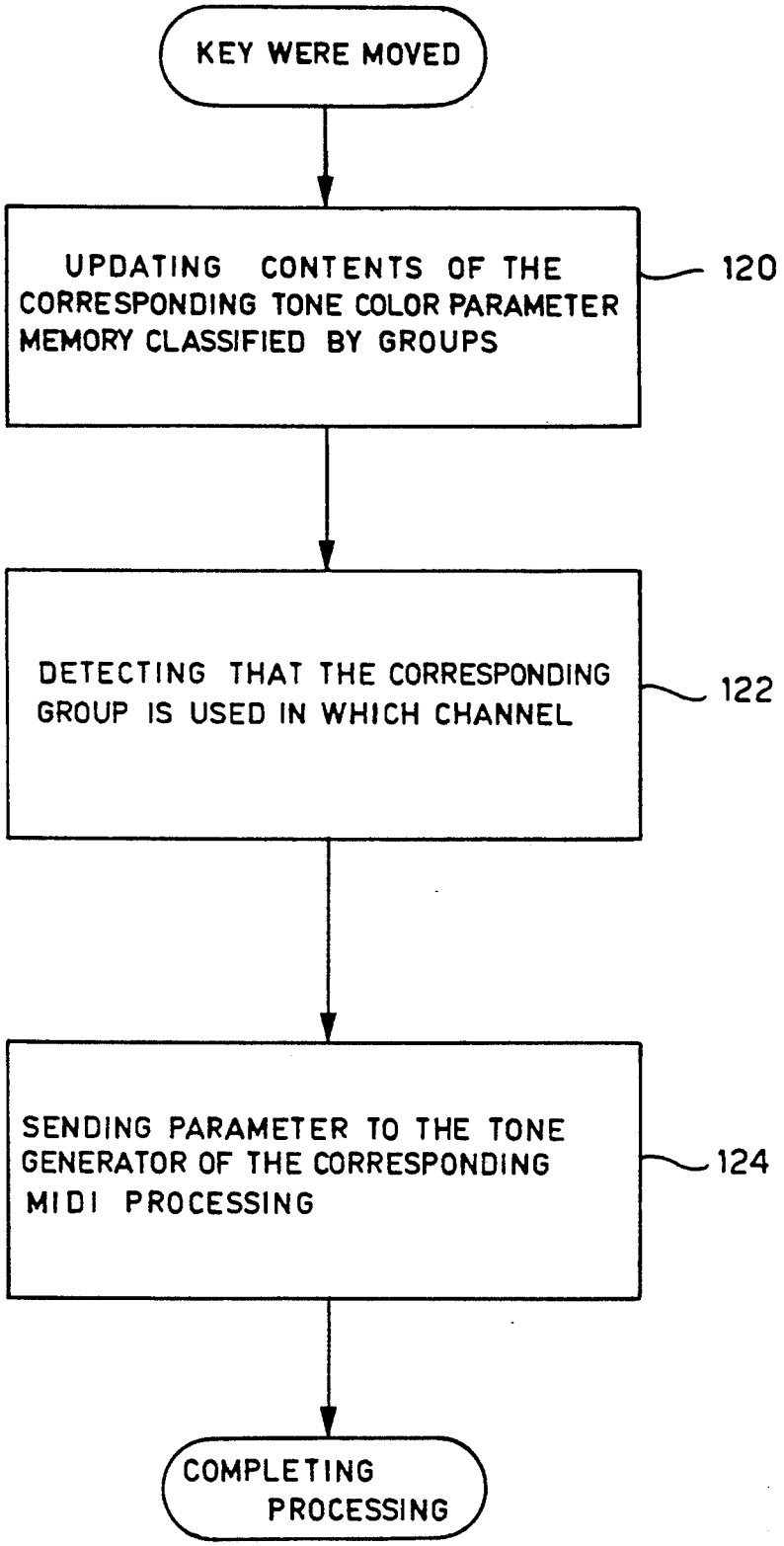
FIG. 8 is a flowchart illustrating processing for changing a tone color parameter classified by groups.

FIG. 8 is a flowchart illustrating a routine in the case where the respective parameter values of Nos. 17–20 parameters in the tone color parameter memory classified by groups 18 are changed. In other words, when it is detected that the parameter changing keys 20 are moved, the parameters are changed in accordance with the flowchart illustrated in FIG. 8.

For changing the parameter values of Nos. 17–20 parameters corresponding to the respective groups A–D stored in the tone color parameter memory classified by groups 18, it is possible to change them by operating keys on the panel as shown in FIG. 5 or 6 even in the midst of the performance. More specifically, for example, if the tone color the parameter of which is intended to change belongs to the group A, Nos. 17–20 parameters belonging to the group A can be changed by operating the keys relating to the group A.

The flowchart will be described hereinbelow in every step.

Step 120: As a result of detecting such fact that the parameter changing keys 20 were moved, such result that which parameter among Nos. 17–20 parameters was changed into what kind of parameter value with respect to which group among the groups A–D is read to update the contents stored in the tone color parameter memory classified by groups 18.

Step 122: It is decided by the current group memory 22 that the group to which the parameter moved by means of the parameter changing keys 20 belongs is used in which MIDI channel. In this case, there is also such an event where tone colors belonging to the same group are used in a plurality of MIDI channels.

Step 124: To the tone generator corresponding to the MIDI channel decided by means of the step 122 is sent such parameter information based on the parameter value updated in the step 120.

According to the routine described above, the parameter values stored in the tone color parameter memory classified by groups 18 are changed, and so changed parameter values are sent to the tone generator.

It is assumed that, for example, from the sequencer 34 the tone color numbering information of tone color No. 2 (bright in acoustic piano) as the musical tone belonging to the group A (in which sound derived from piano is specified), the tone color numbering information of tone color No. 1 as the musical tone belonging to the group B (in which sound derived from bass is specified), and further the tone color numbering information of tone color No. 100 (mellow in acoustic piano) as the musical tone belonging to the group A are sent to the MIDI channel-1, MIDI channel-2 and MIDI channel-3, respectively, as shown in FIG. 4.

In the state described above, when the respective key-on or key-off information for the respective MIDI channels is output from the sequencer 34, the performance sound of the tone color corresponding to tone color No. 2, the performance sound of the tone color corresponding to tone color No. 1, and the performance sound of the tone color corresponding to tone color No. 100 are mixed with each other to sound musical tones from the speaker 38.

Under the condition described above, it seems very difficult for a player who is playing the electronic musical instrument to recognize that the tone color of which color number is now on sounding by merely hearing the musical tones sounded from the speaker 38. A degree of the recognition is only such that ensemble is performed by means of the performance sounds of tone color derived from piano and the performance sounds of tone color derived from bass at the most. In this condition, when it is intended to reduce the sounds derived from piano because of, for example, such reason that the performance sounds of tone color derived from piano are too loud, it may be sufficient to operate changing parameters in the group A, since the tone colors derived from piano are classified into the group A. When it is detected in the step 120 that keys in the group A were operated, it is also detected in the step 122 that the tone colors in the group A are used in which MIDI channel. In this case, it is detected by the current group memory 22 that the group A is employed in the MIDI channel-1 and the MIDI channel-3, respectively, as shown in FIG. 4. Then, in the step 124, the parameter values changed in the step 120 are sent to both the channel-1 tone generator 24 and the channel-3 tone generator 28 corresponding to the MIDI channels 1 and 3 detected in the step 122, whereby the musical tones sounds from the speaker 38 are changed so that the tone color derived from piano can be decreased.

As described above, in the case where the classification by groups is made in accordance with a conception such as tone color property which is generally acceptable, when a player finds to require changing parameters with respect to the sounding tone of acoustic piano in every group, setting of the parameters can simply be changed by operating keys in a single group, because the former groups are classified into the same group simply as one for tone color derived from piano irrespective of the tone color set by tone color number is either "bright in acoustic piano" or "mellow in acoustic piano". Accordingly, the player is not required to confirm tone color number or MIDI channel in which the tone color number is used by visual observation and the like each time.

In the present embodiment, while such parameter changing means wherein the parameters are stored individually in a tone color parameter memory in every tone color has not yet been described in detail, it is, of course, possible to change such parameters by means of a heretofore known means.

Moreover, although "tone color" among "tone characters" is especially described in the above-mentioned embodiment, the present invention is not limited thereto, but also applicable to volume and pitch of musical tone or effect imparted thereto and the like as has been described above.

Since the present invention has been constructed as described above, the advantages which will be described hereinbelow are obtained therefrom.

Since there are many cases where parameters have substantially the same values among a plurality of similar tone characters in respect of a certain kind of parameters, such parameters made to be common with each other in a plurality of tone characters and used with respect to a plurality of such tone characters having the same values as to a certain parameter without setting these parameters separately from one another in the present invention. Thus, a memory size required for storing individual parameters can be reduced in the parameter setting system according to the present invention.

Furthermore, in respect of parameters having common values among some tone characters, one group is made up from these tone characters and such a parameter value being common in the groups is set as a value representing the groups without setting separate paramters with the respective tone characters in the parameter setting system of this invention. Accordingly, when a tone character is selected with reference to the tone character belonging to the same group, a parameter value representing a certain group in respect of said parameter is sent to a musical tone producing means. For this reason, the more types of common parameters being common in a plurality of tone characters permit, the more reduction of memory size in the present parameter setting system.

In addition, in the case where such parameters wich are common in a plurality of tone characters and have been sent in every group are changed, when only a value representing the groups is changed without changing values in every individual tone character, the questioned parameters of all the tone color etc. in the groups are changed simultaneously with respect to the questioned plural tone characters so that the operation therefore is simplified.

Besides, when a certain group is specified and then, parameters are changed, such a musical tone producing means in which tone character belonging to the specified group have been set is detected, and the parameter value changed is sent to the detected musical tone producing means. Accordingly, there is no need to individually confirm objective tone character for changing parameters so that the operation for changing parameters can be simplified.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A parameter setting system in an electronic musical instrument for setting parameters of a set of tone characters, which tone characters are for producing musical tones in an electronic musical instrument, and in which at least a sub-set of tone characters pertaining to a same sound classification category has at least one parameter of the same value, the system comprising:

a first parameter storing means classified by groups in which common parameters of said subset of tone characters pertaining to a same category, which are at least part of the parameters among all the types of parameters as to said subset of tone characters, are classified into a group in which the number of groups of characters is smaller than the total number of said subset of tone characters of the same category, and in which said common parameters are stored in every said groups in a readable manner;

a group specifying means for specifying said groups into which said common parameters are classified in every said tone characters;

a second parameter storing means for individually storing parameters other than said common parameters which are stored in said first parameter storing means, classified by groups in every said subset of tone characters in a readable manner;

a parameter sending means for specifying said groups into which said common parameters have been classified by means of said group specifying means, and outputting said common parameters in said specified groups from said first parameter storing means classified by groups, to a musical tone producing means, when tone characters are selected among said subset of tone characters; and a second parameter sending means for outputting said other parameters as to said prescribed tone characters from said second parameter storing means, to said musical tone producing means.

2. A parameter setting system in an electronic musical instrument, for setting and changing parameters of a set of tone characters which are for producing musical tones in an electronic musical instrument having a plurality of musical tone producing means, comprising:

a group specifying means for classifying said tone characters into a number of groups smaller than the total number of the respective musical tones and specifying said groups into which said tone characters have been classified in every said musical tones;

a parameter changing means for changing said parameters and specifying said groups to which said tone characters belong;

correspondence relationship storing means for setting said groups of tone characters to said plurality of musical tone producing means, respectively, and storing the corresponding relationships between said musical tone producing means and said group of tone characters in a readable and writable manner; and a changed parameters sending means for outputting the changed parameters to a musical tone producing means corresponding to said specified groups of tone characters which are stored by said correspondence relationship storing means, as a result of specifying said groups of tone characters and when said parameters of said tone characters belonging to said specified groups are changed by means of said parameter changing means.

3. The parameter setting system of claim 1, wherein said tone characters comprise at least one of color, pitch, volume, and imparted sound effects.

4. The parameter setting system of claim 2, wherein said tone characters comprise at least one of color, pitch, volume, and imparted sound effects.

* * * * *